US012607382B1

(12) United States Patent
Han

(10) Patent No.: US 12,607,382 B1
(45) Date of Patent: Apr. 21, 2026

(54) AIR PURIFYING APPARATUS

(71) Applicant: Sung Wook Han, Seoul (KR)

(72) Inventor: Sung Wook Han, Seoul (KR)

( * ) Notice: Subject to any disclaimer, the term of this patent is extended or adjusted under 35 U.S.C. 154(b) by 0 days.

(21) Appl. No.: 19/026,570

(22) Filed: Jan. 17, 2025

(30) Foreign Application Priority Data

Nov. 26, 2024 (KR) ..... 10-2024-0170809

(51) Int. Cl.

| | |
|---|---|
| ***F24F 11/72*** | (2018.01) |
| ***F24F 8/108*** | (2021.01) |
| ***F24F 8/22*** | (2021.01) |
| ***F24F 11/56*** | (2018.01) |
| ***F24F 110/66*** | (2018.01) |

(52) U.S. Cl.
CPC ..... *F24F 11/72* (2018.01); *F24F 8/108* (2021.01); *F24F 8/22* (2021.01); *F24F 11/56* (2018.01); *F24F 2110/66* (2018.01)

(58) Field of Classification Search
None
See application file for complete search history.

(56) References Cited

FOREIGN PATENT DOCUMENTS

| | | |
|---|---|---|
| KR | 20040029352 | 4/2004 |
| KR | 200490315 | 10/2019 |
| KR | 20190129150 | 11/2019 |
| KR | 102367603 | 2/2022 |

OTHER PUBLICATIONS

"Office Action of Korea Counterpart Application", issued on Mar. 25, 2025, with English translation thereof, p. 1-p. 11.

*Primary Examiner* — Brit E. Anbacht
(74) *Attorney, Agent, or Firm* — JCIPRNET

(57) ABSTRACT

The present invention relates to an air purifying apparatus including a plurality of main bodies each having a treatment chamber formed therein and having an air inlet and an air outlet formed therein, a measuring part provided in the main bodies to measure environment information of the installation regions, an air blowing part installed in the treatment chamber to forcibly suction air of the installation regions into the air inlet and then discharge the air to the air outlet, a filter part provided in the treatment chamber to pass and filter the air introduced into the air inlet and then move the air to the air outlet, a sterilizing part provided in the treatment chamber to, when turned on, radiate ultraviolet (UV) light to the outside and sterilize the air of harmful components, and a controller electrically connected to the measuring part, the air blowing part.

1 Claim, 13 Drawing Sheets

AIR PURIFYING APPARATUS

CROSS-REFERENCE TO RELATED APPLICATION

This application claims priority to and the benefit of Korean Patent Application No. 10-2024-0170809, filed on Nov. 26, 2024, the disclosure of which is incorporated herein by reference in its entirety.

BACKGROUND

Technical Field

The present invention relates to an air purifying apparatus, and more particularly, to an air purifying apparatus that can reduce electrical energy usage due to being driven based on air quality data and can improve convenience of maintenance because one or more air purifying apparatuses installed in a plurality of regions are managed in an integrated manner.

Description of Related Art

The interest in indoor air quality has steadily increased in recent years due to its significant influence on human health.

Since an exposure to an environment with a bad indoor air quality for a long period of time may lead to a respiratory disease, an allergy, a cardiovascular disease, etc., there is an increasing trend in the demand for air purifying apparatuses. In particular, after the COVID-19 pandemic, the importance of maintaining a clean, healthy indoor environment has been emphasized.

However, despite such an increase in the demand, most commercially available air purifiers require high power consumption, making it burdensome to operate, contribute to increasing carbon emission due to high energy usage, and are not suitable for application to various installation environments due to having a large volume, which makes it difficult to secure an installation space.

As the related art of the present invention, Korean Unexamined Patent Application Publication No. 10-2004-0029352 (Apr. 6, 2004) discloses an air purifying apparatus.

SUMMARY

The present invention is directed to providing an air purifying apparatus that can reduce electrical energy usage due to being driven based on air quality data and can improve convenience of maintenance because one or more air purifying apparatuses installed in a plurality of regions are managed in an integrated manner.

According to an aspect of the present invention, there is provided an air purifying apparatus of which one or more are provided in a plurality of installation regions, the air purifying apparatus including a plurality of main bodies each having a treatment chamber formed therein and having an air inlet and an air outlet formed therein, a measuring part provided in the main bodies to measure environment information of the installation regions, an air blowing part installed in the treatment chamber to forcibly suction air of the installation regions into the air inlet and then discharge the air to the air outlet, a filter part provided in the treatment chamber to pass and filter the air introduced into the air inlet and then move the air to the air outlet, a sterilizing part provided in the treatment chamber to, when turned on, radiate ultraviolet (UV) light to the outside and sterilize the air of harmful components, and a controller electrically connected to the measuring part, the air blowing part, and the sterilizing part and performing variable control of an operation of the air blowing part according to the measured information transmitted from the measuring part.

In addition, the air purifying apparatus may further include a communication module electrically connected to the controller and a terminal part transmitting and receiving information to and from the communication module using a wireless communication method and provided to be remotely controllable.

In addition, the measuring part may further include a particulate matter sensor having a sensing side exposed to an outer surface of the main body, measuring a particulate matter concentration of the installation region, and transmitting the measured particulate matter concentration to the controller, a volatile organic compound sensor having a sensing side exposed to the outer surface of the main body, measuring a volatile organic compound concentration of the installation region, and transmitting the measured volatile organic compound concentration to the controller, a carbon dioxide sensor having a sensing side exposed to the outer surface of the main body, measuring a carbon dioxide concentration of the installation region, and transmitting the measured carbon dioxide concentration to the controller, and a temperature/humidity sensor having a sensing side exposed to the outer surface of the main body, measuring a temperature and a humidity level of the installation region, and transmitting the measured temperature and humidity level to the controller.

In addition, the filter part may divide the treatment chamber into a front space and a rear space, the air inlet and the air outlet may be formed in both side surfaces and a front surface, respectively, of the main body to communicate with the front space and the rear space, respectively, and the air blowing part may be provided in the rear space to move the air introduced into the air inlet to the front space through the filter part.

In addition, the filter part may include a high-efficiency particulate air (HEPA) filter provided in the treatment chamber and capable of filtering out matter of 0.3 microns or less in size from the air and an activated carbon filter provided in front of or behind the HEPA filter and including an activated carbon component.

BRIEF DESCRIPTION OF THE DRAWINGS

The above and other objects, features, and advantages of the present invention will become more apparent to those of ordinary skill in the art by describing exemplary embodiments thereof in detail with reference to the accompanying drawings, in which.

DESCRIPTION OF THE EMBODIMENTS

Hereinafter, exemplary embodiments according to the present invention will be described in detail with reference to the accompanying drawings.

Advantages and features of the present invention and methods of achieving the same should become clear from embodiments described in detail below with reference to the accompanying drawings.

However, the present invention is not limited to the embodiments disclosed below and may be implemented in various different forms. The present embodiments are only provided to make the disclosure of the present invention complete and completely inform those of ordinary skill in the art to which the present invention pertains of the scope of the invention. The scope of the present invention is only defined by the scope of the claims.

In addition, in describing the present invention, when it is determined that the detailed description of a known related art may obscure the gist of the present invention, the detailed description thereof will be omitted.

Figure 1:
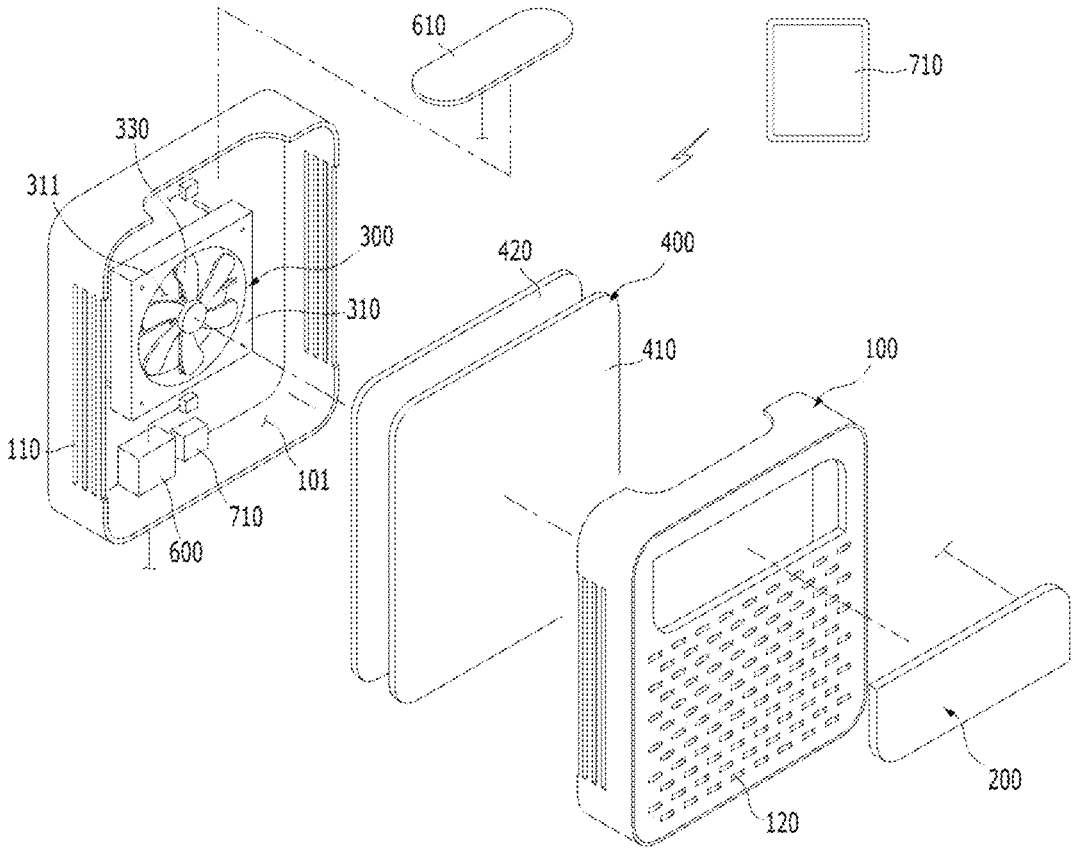
FIG. 1 is an exploded perspective view for showing an air purifying apparatus according to the present invention.
Figure 2:
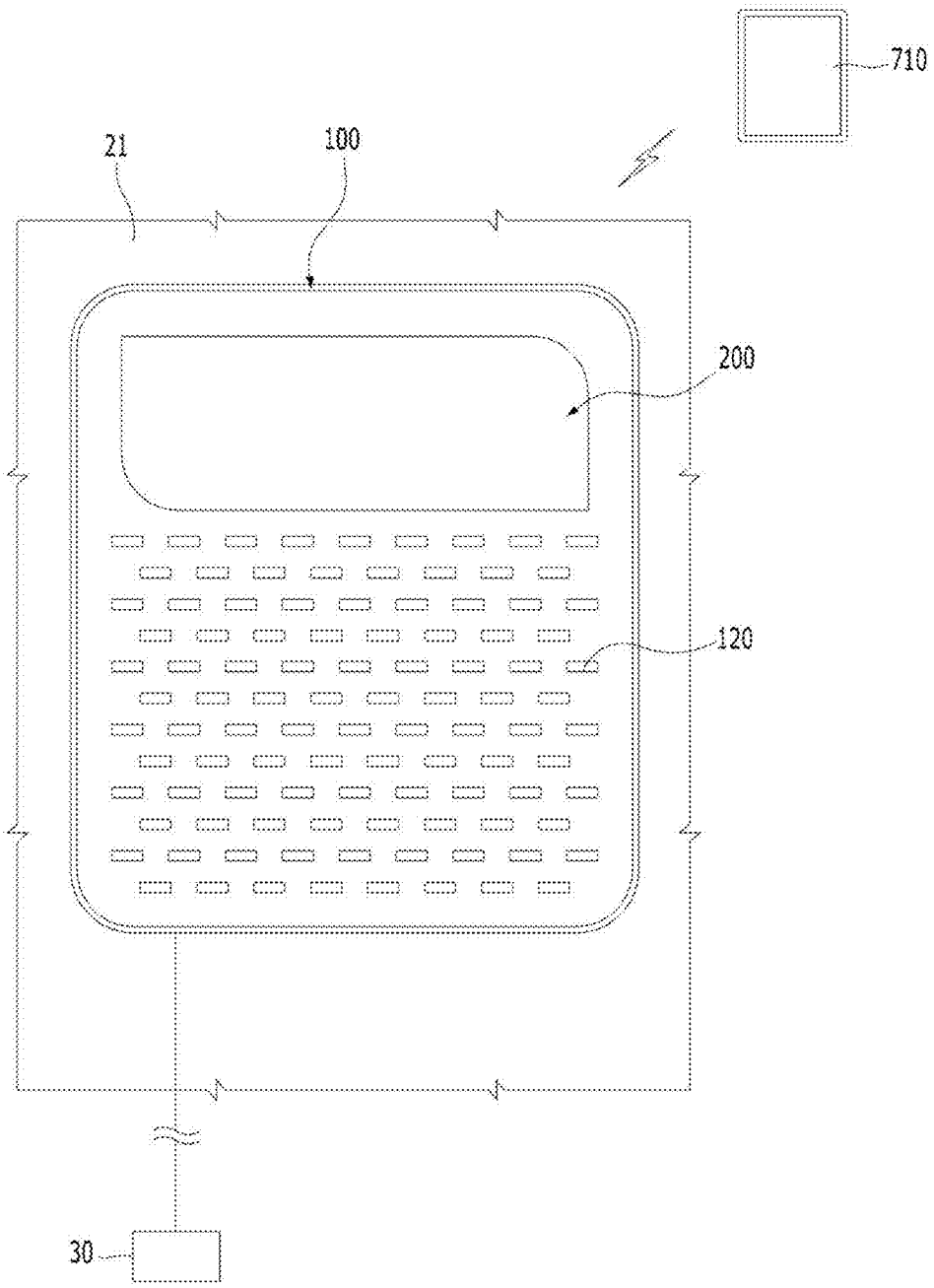
FIG. 2 is a front view for showing the air purifying apparatus according to the present invention.
Figure 3:
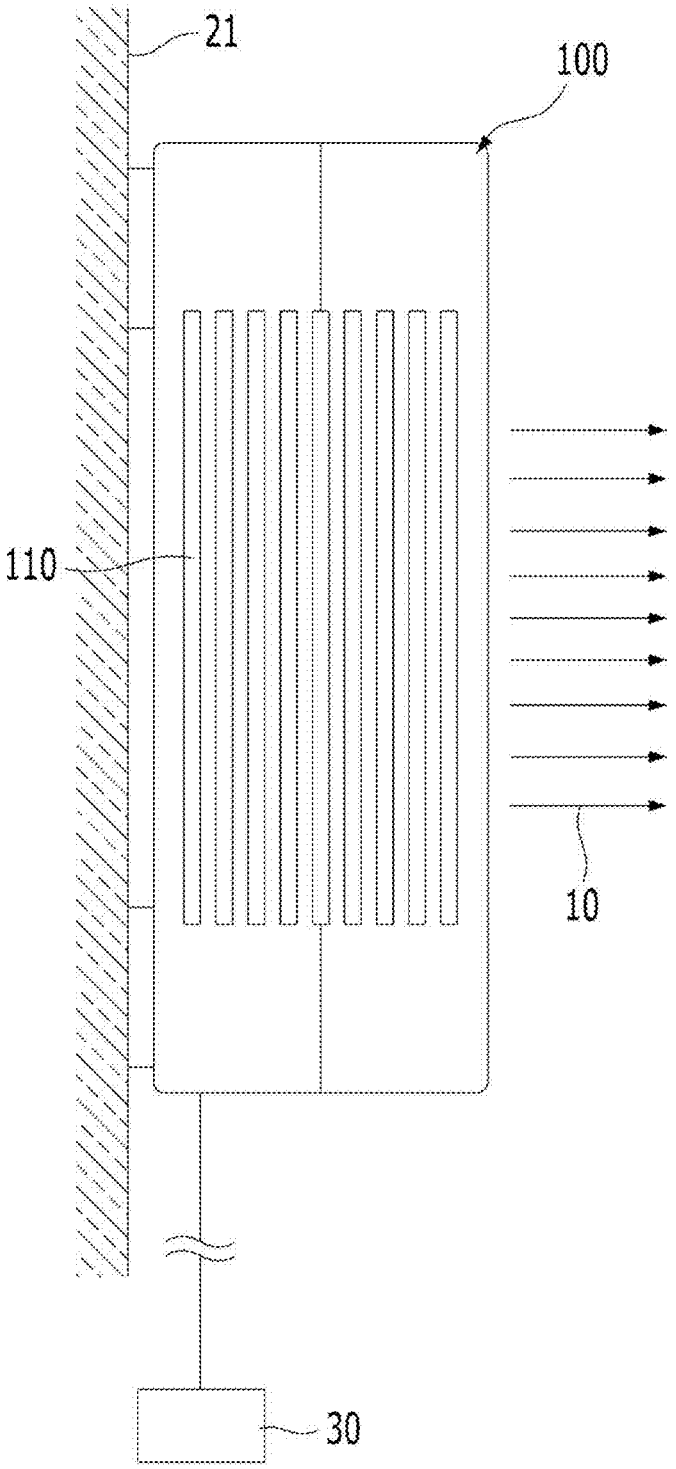
FIG. 3 is a side view for showing the air purifying apparatus according to the present invention.
Figure 4:
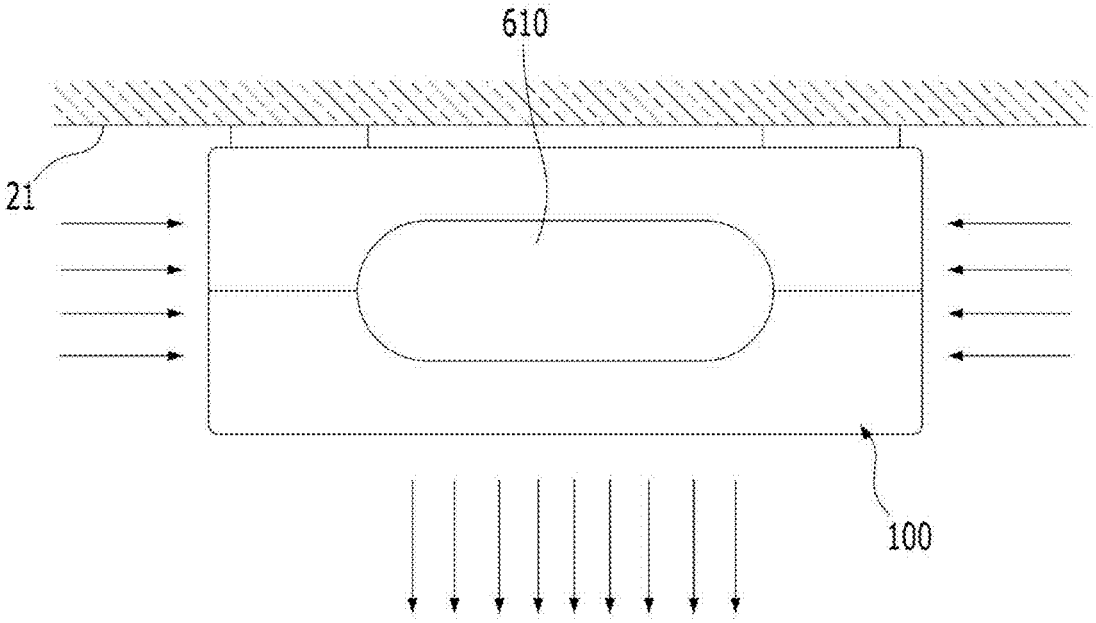
FIG. 4 is a top view for showing the air purifying apparatus according to the present invention.
Figure 5:
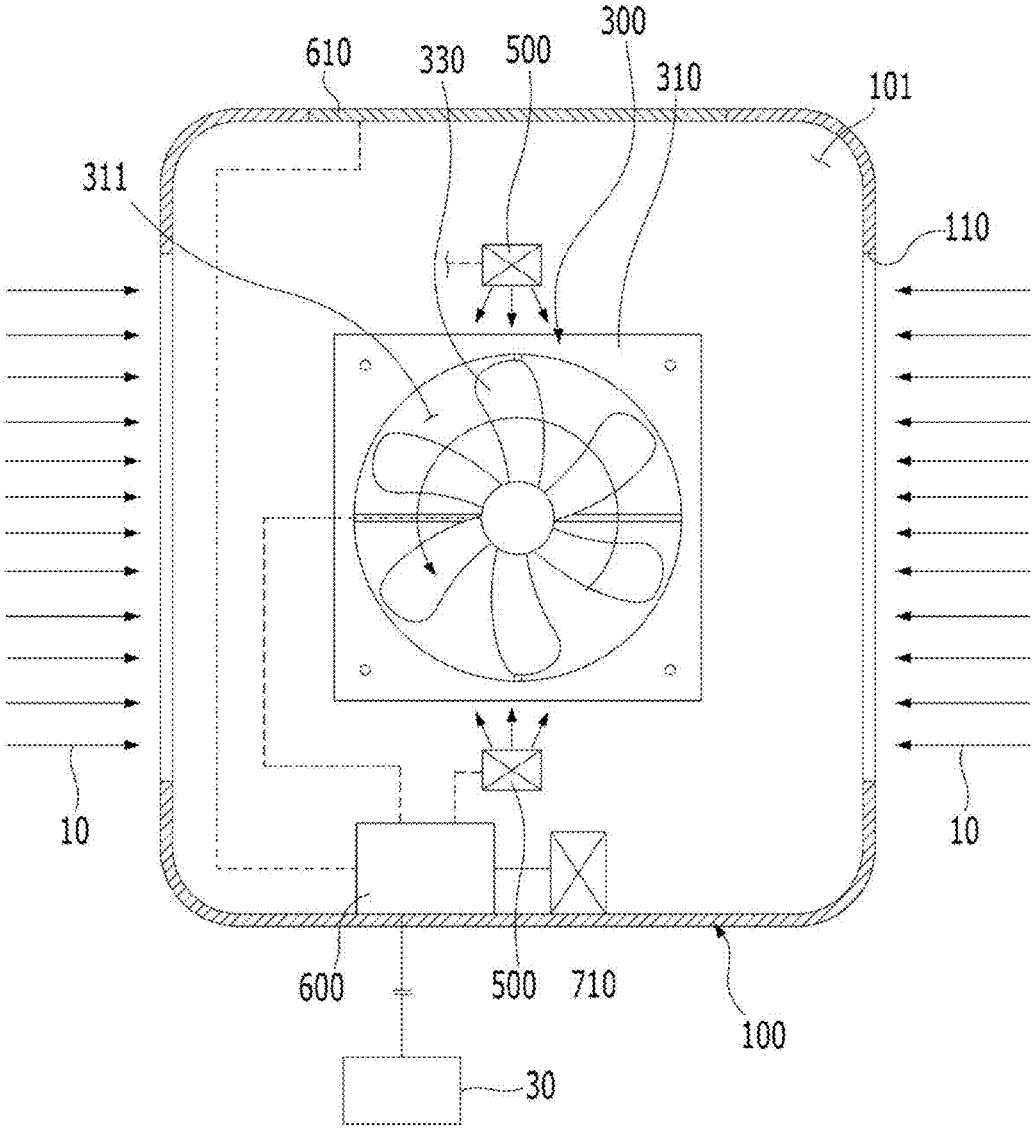
FIG. 5 is a front view for showing an air blowing part by opening a front of a main body of the air purifying apparatus according to the present invention.
Figure 6:
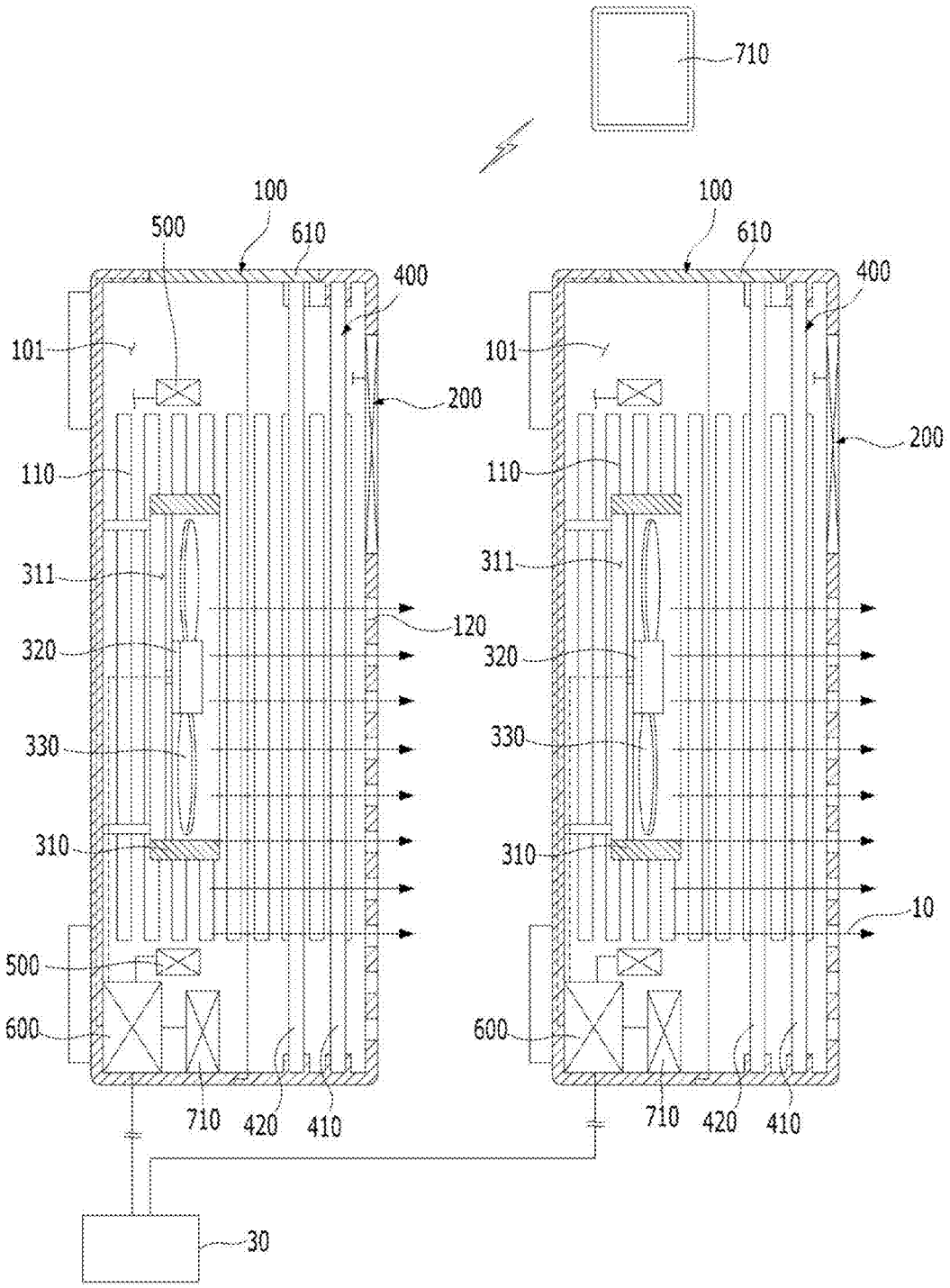
FIG. 6 is a side cross-sectional view for showing the air purifying apparatus according to the present invention.
Figure 7:
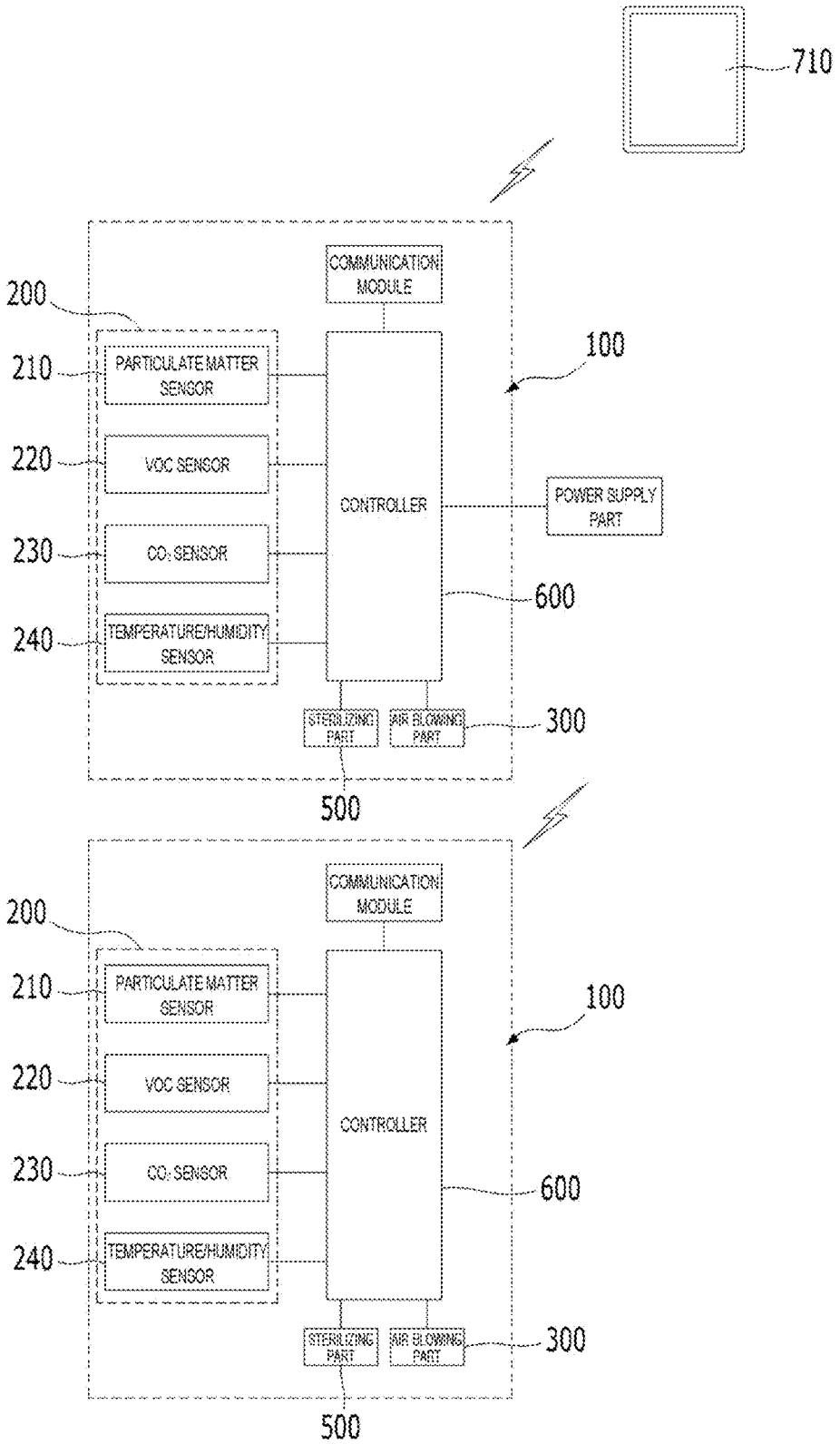
FIG. 7 is a block diagram for schematically showing connection relations between components of the air purifying apparatus according to the present invention.
Figure 8:
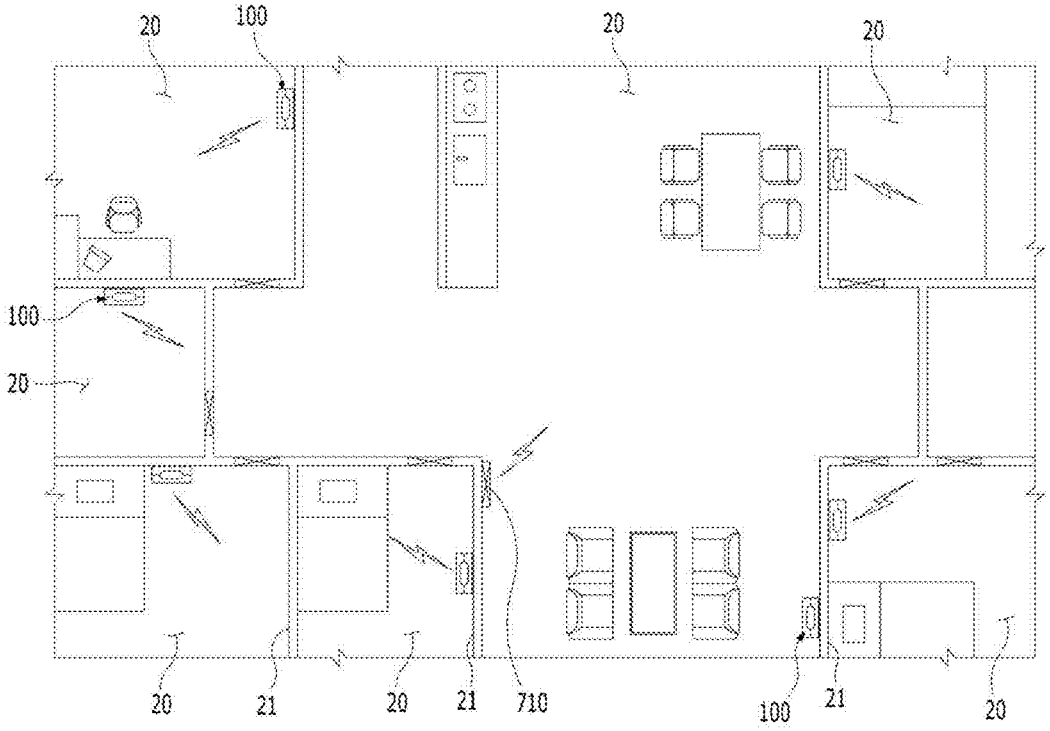
FIG. 8 is a top view for showing a state in which the air purifying apparatus according to the present invention is installed in an indoor installation region.

FIG. 1 is an exploded perspective view for showing an air purifying apparatus according to the present invention, FIG. 2 is a front view for showing the air purifying apparatus according to the present invention, FIG. 3 is a side view for showing the air purifying apparatus according to the present invention, FIG. 4 is a top view for showing the air purifying apparatus according to the present invention, FIG. 5 is a front view for showing an air blowing part by opening a front of a main body of the air purifying apparatus according to the present invention, FIG. 6 is a side cross-sectional view for showing the air purifying apparatus according to the present invention, FIG. 7 is a block diagram for schematically showing connection relations between components of the air purifying apparatus according to the present invention, and FIG. 8 is a top view for showing a state in which the air purifying apparatus according to the present invention is installed in an indoor installation region.

Figure 9:
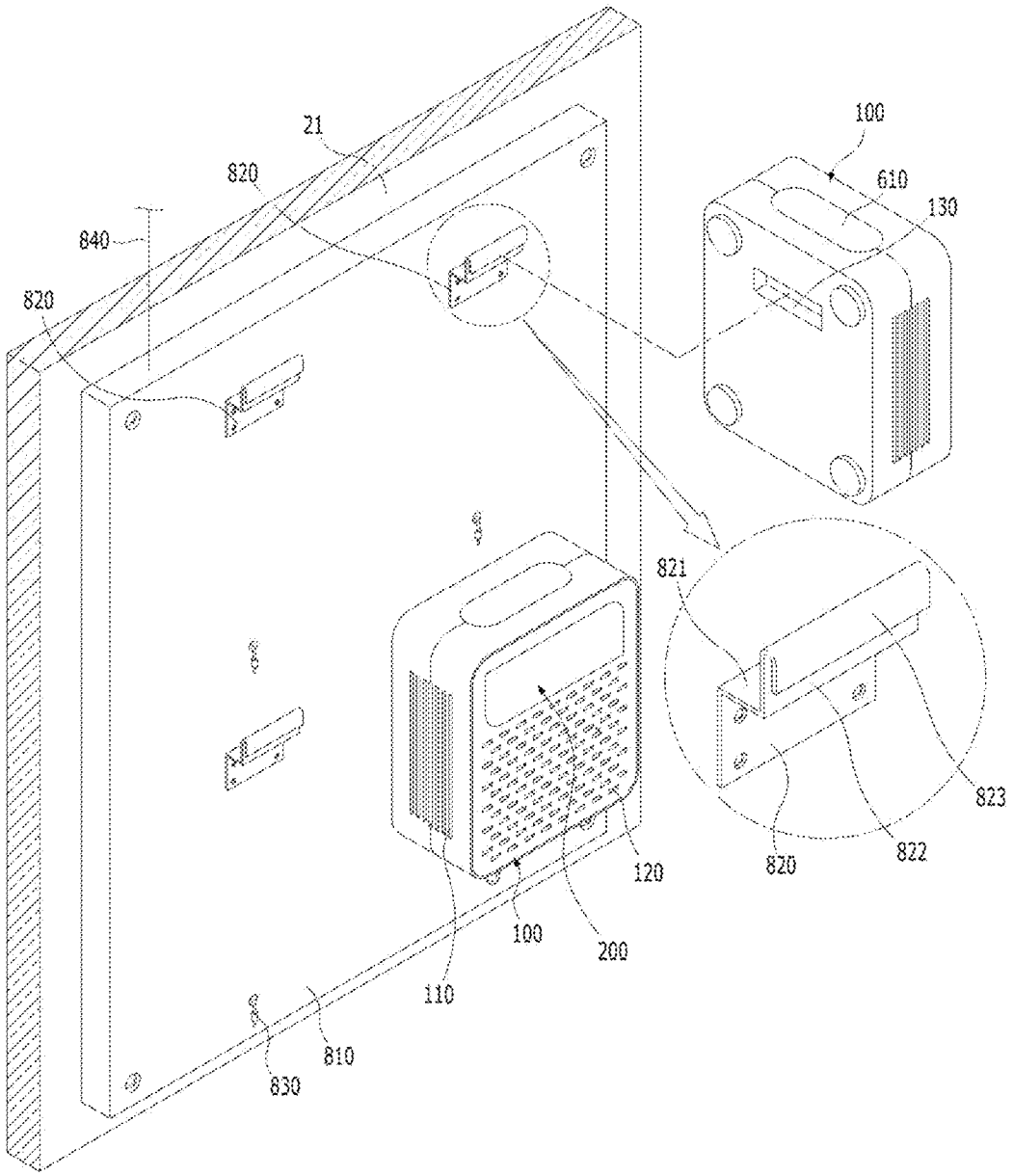
FIG. 9 is a perspective view for showing a state in which an installation panel and a mounting member are applied to the air purifying apparatus according to the present invention.
Figure 10:
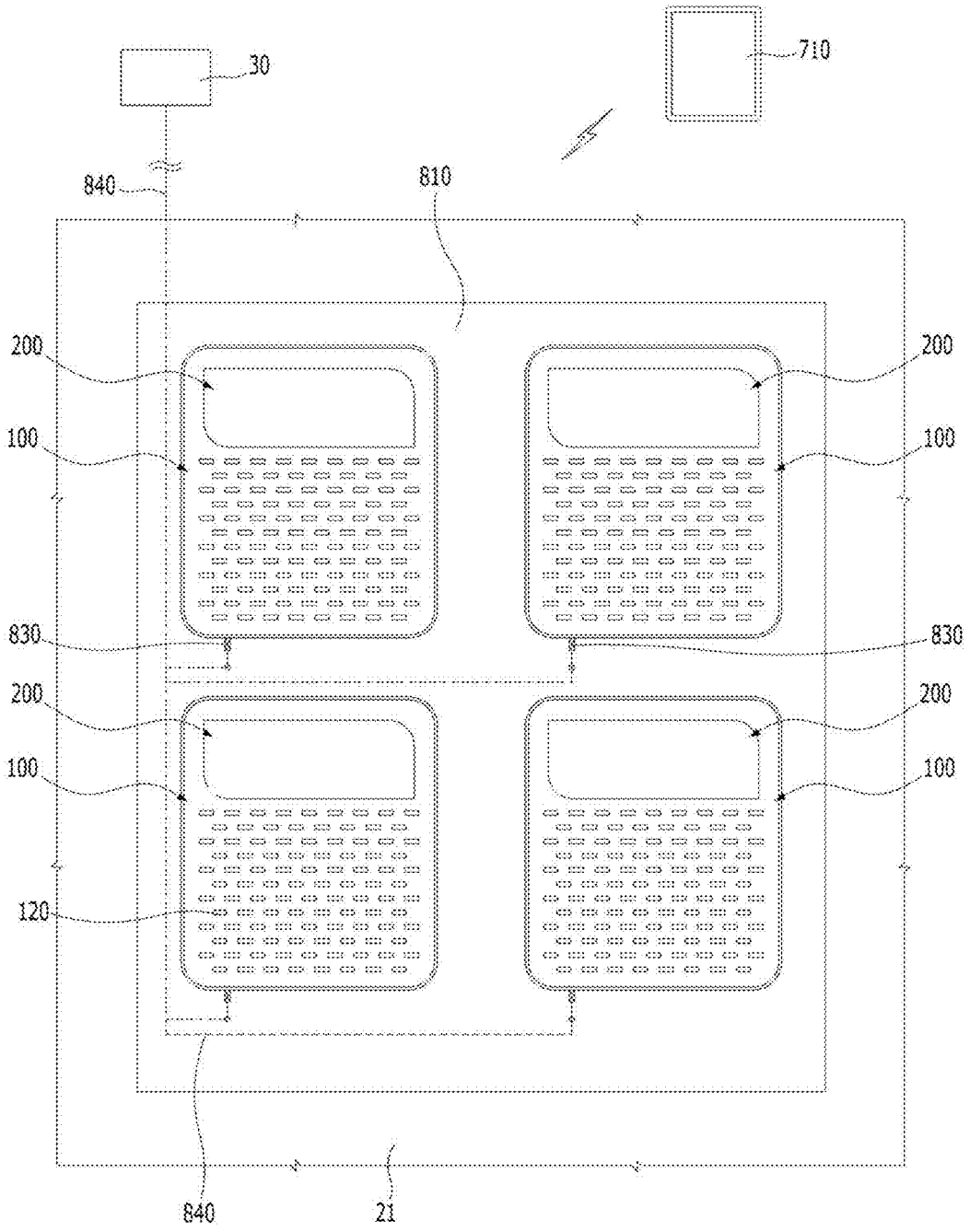
FIG. 10 is a front view for showing the air purifying apparatus according to FIG. 9.
Figure 11:
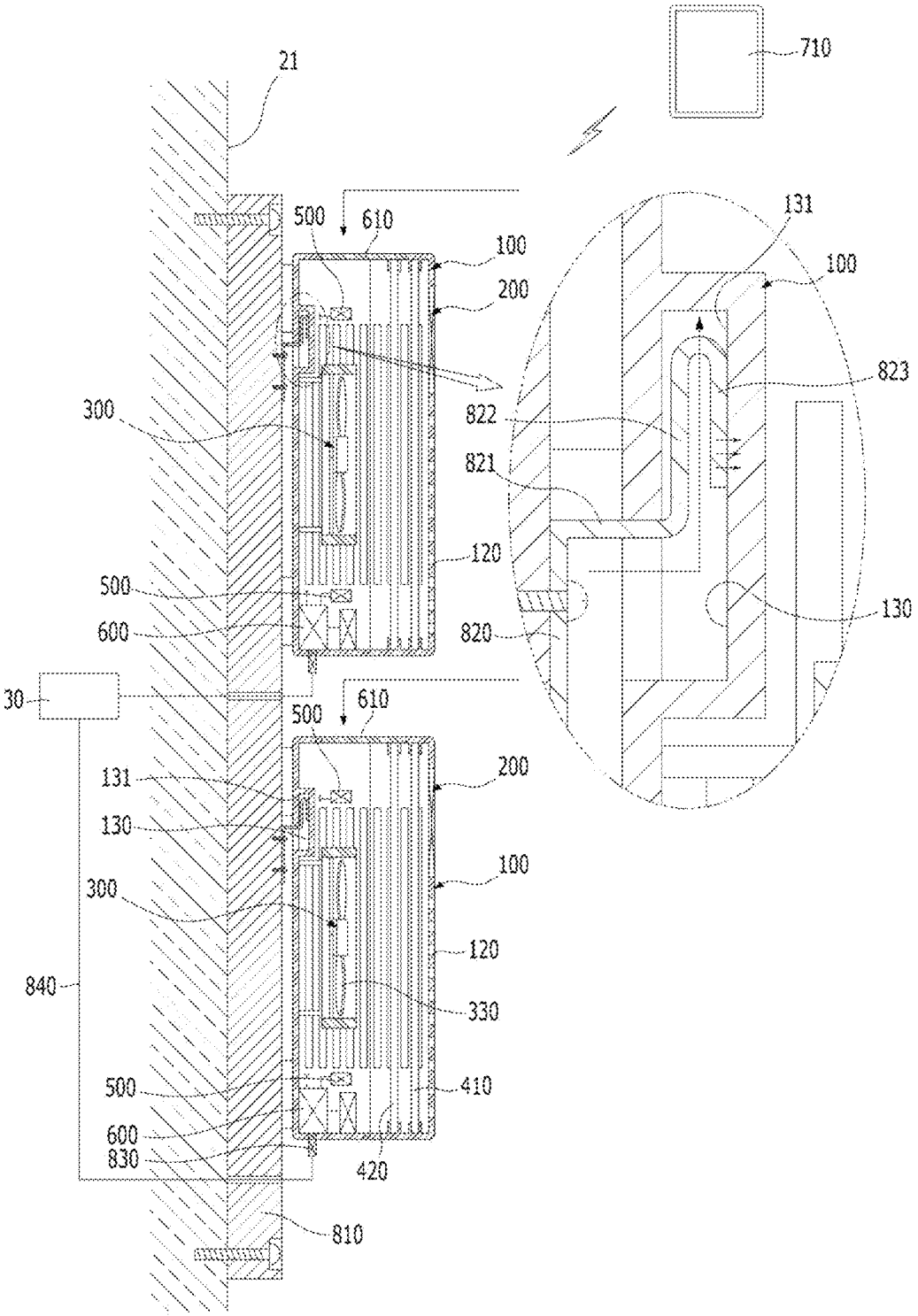
FIG. 11 is a side cross-sectional view for showing the air purifying apparatus according to FIG. 9.
Figure 12:
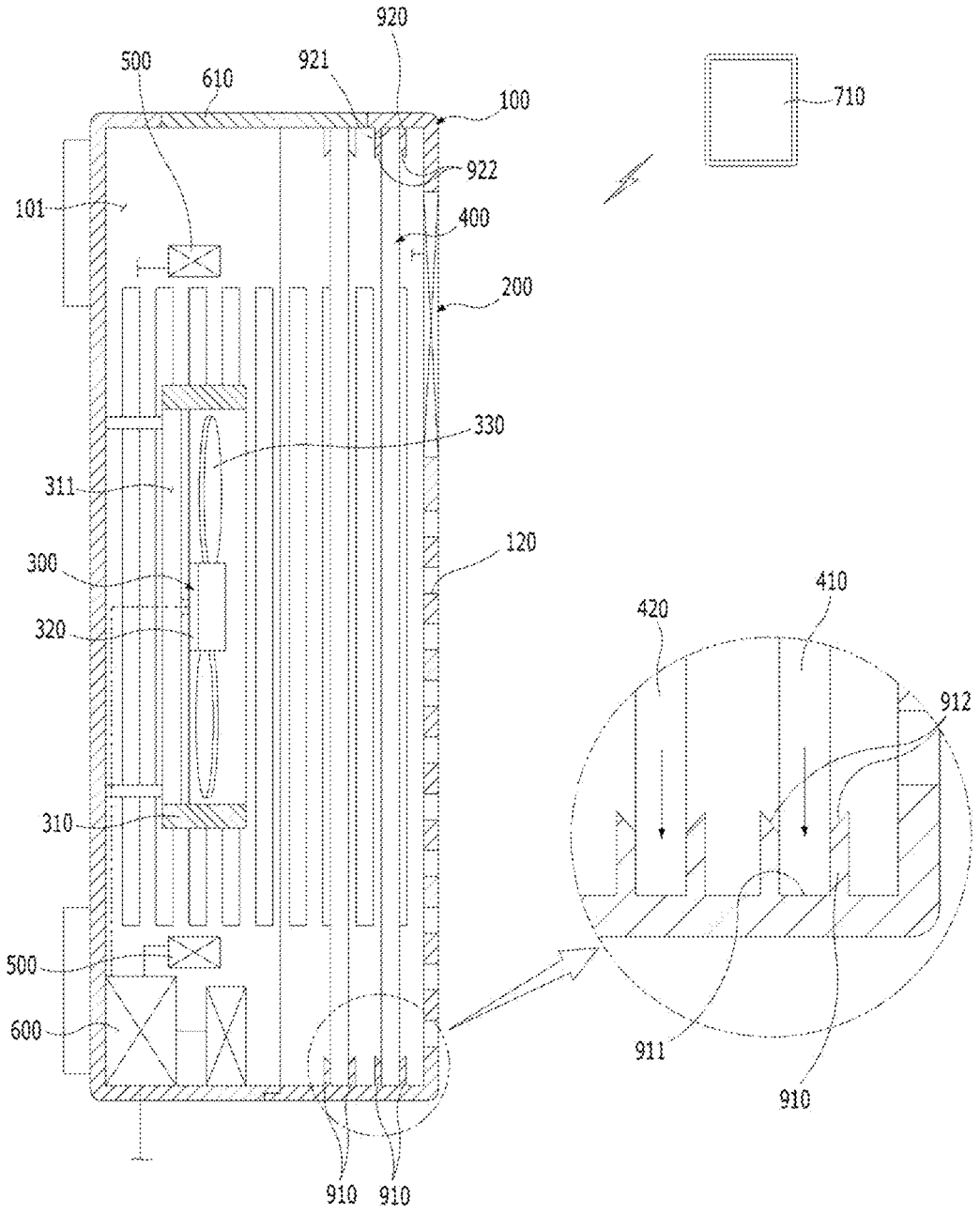
FIG. 12 is a side cross-sectional view for showing a state in which a lower slot and an upper slot are applied to the air purifying apparatus according to the present invention.
Figure 13:
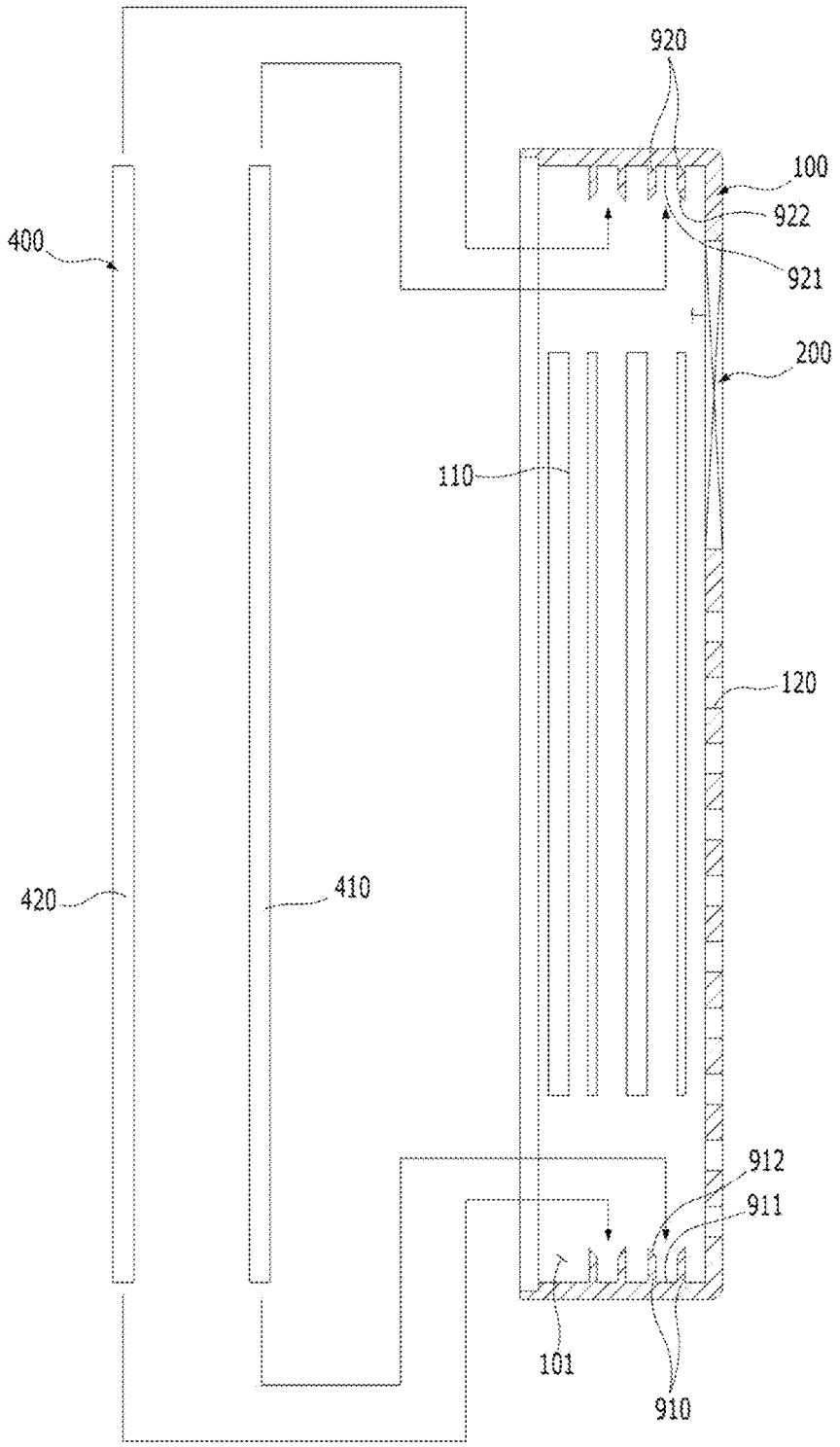
FIG. 13 is a side cross-sectional view for showing a process of coupling a filter part to the lower slot and the upper slot of the air purifying apparatus according to FIG. 12.

FIG. 9 is a perspective view for showing a state in which an installation panel and a mounting member are applied to the air purifying apparatus according to the present invention, FIG. 10 is a front view for showing the air purifying apparatus according to FIG. 9, FIG. 11 is a side cross-sectional view for showing the air purifying apparatus according to FIG. 9, FIG. 12 is a side cross-sectional view for showing a state in which a lower slot and an upper slot are applied to the air purifying apparatus according to the present invention, and FIG. 13 is a side cross-sectional view for showing a process of coupling a filter part to the lower slot and the upper slot of the air purifying apparatus according to FIG. 12.

Referring to FIGS. 1 to 13, one or more of an air purifying apparatus according to the present invention are provided in a plurality of installation regions 20 (a living room, a room, etc.), and the air purifying apparatus according to the present invention includes a main body 100, a measuring part 200, an air blowing part 300, a filter part 400, a sterilizing part 500, and a controller 600.

The main body 100 is disposed in the installation regions 20 of various building structures, and the installation regions 20 may include an indoor space of each household or office. The main body 100 may be fixed while mounted on a wall 21 of the installation regions 20, but the position at which the main body 100 is fixed and the method of fixing the main body 100 may be changed as necessary.

In addition, the main body 100 may be manufactured using various materials, and a treatment chamber 101 through which air is able to pass is formed inside the main body 100. The main body 100 may include a rear body having the treatment chamber 101 formed on a front surface and a front body having the treatment chamber formed on a rear surface and capable of being coupled to and separated from a front end of the rear body.

In addition, one or more air inlets 110 into which air 10 is introduced may be formed in one or more of both side surfaces of the main body 100, one or more air outlets 120 to which the air 10 is discharged may be formed in a front surface of the main body 100, and a plurality of support members coming into contact with the wall 21 or the like when the main body 100 comes into close contact with the wall 21 or the like may be coupled to a rear surface of the main body 100.

Further, the rear surface of the main body 100 may be mounted by a holder (not illustrated) or the like installed on the wall 21 or the like, the main body 100 may be coupled to the wall 21 or the like by a separate fastening member (not illustrated), or a holding groove or the like to which the holder is able to be coupled may be provided on the rear surface or the like of the main body 100.

The measuring part 200 is a component for sensing various environment information (a particulate matter concentration, a temperature, a humidity level, etc.) of the installation regions 20 and may be installed in the treatment chamber 101, and a sensing side of the measuring part 200 may be exposed through the front surface of the main body 100.

For example, an installation hole in which the measuring part 200 is installed may pass through the front surface of the main body 100 in a front-rear direction, the installation hole may be located in an upper region of the air outlet 120, and the measuring part 200 may be exposed to the front of the main body 100 in a state in which an edge of the measuring part 200 is coupled to an inner peripheral surface of the installation hole.

The measuring part 200 according to one embodiment of the present invention may further include a particulate matter sensor 210 having a sensing side exposed to the front surface of the main body 100, measuring a particulate matter concentration of the installation regions 20, and transmitting the measured particulate matter concentration to the controller 600 which will be described below, a volatile organic compound (VOC) sensor 220 having a sensing side exposed to the front surface of the main body 100, measuring a VOC concentration of the installation regions 20, and transmitting the measured VOC concentration to the controller 600, a carbon dioxide (CO2) sensor 230 having a sensing side exposed to the front surface of the main body 100, measuring a CO2 concentration of the installation regions 20, and transmitting the measured CO2 concentration to the controller 600, and a temperature/humidity sensor 240 having a sensing side exposed to the outer surface of the main body 100, measuring a temperature and a humidity level of the installation regions 20, and transmitting the measured temperature and humidity level to the controller 600.

The particulate matter sensor 210 may measure particulate matter (PM2.5, PM10) in real time and may accurately measure particles in air using laser scattering technology. That is, since a concentration of particles floating in the installation regions 20 can be effectively measured, and measured information is transmitted to a terminal part 720 through the controller 600, a particulate matter concentration of each installation region 20 can be monitored in an integrated manner.

The VOC sensor 220 may measure a VOC concentration of the installation regions 20 in real time, a VOC sensing range of the VOC sensor 220 may be 0 to 1,000 ppb, and a response time of the VOC sensor 220 may be less than 10 seconds.

That is, since the VOC sensor 220 can effectively measure a concentration of VOCs floating in the installation regions 20, and measured information is transmitted to the terminal part 720 through the controller 600, a VOC concentration of each installation region 20 can be monitored in an integrated manner, and overall evaluation of air quality parameters can be performed through an integration function.

The CO2 sensor 230 may accurately sense a CO2 level of the installation regions 20 using non-dispersive infrared (NDIR) technology and may provide a measurement range of 0 to 5,000 ppm.

That is, since the CO2 sensor 230 can effectively measure a CO2 concentration of the installation regions 20, and measured information is transmitted to the terminal part 720 through the controller 600, a CO2 concentration of each installation region 20 can be monitored in an integrated manner.

The temperature/humidity sensor 240 is a component for monitoring temperatures and humidity levels of the installation regions 20, and since the temperatures and humidity levels of the installation regions 20 measured by the temperature/humidity sensor 240 are transmitted to the terminal part 720 through the controller 600, the temperature and humidity level of each installation region 20 can be monitored in an integrated manner.

The particulate matter sensor 210, the VOC sensor 220, the CO2 sensor 230, and/or the temperature/humidity sensor 240 may each have a sensing side exposed to the front through the installation hole of the main body 100 and may be electrically connected to the controller 600 and transmit various measured information thereto in real time.

At this time, the controller 600 may send the measured information to the terminal part 720, which will be described below, using a wireless communication method, a user may recognize the overall environment information output or displayed through the terminal part 720, and the user may control an operation state of the air purifying apparatus using the terminal part 720 when necessary.

In addition, the type of the measuring part 200 installed in the main body 100 and the number of measuring parts 200 installed in the main body 100 may be changed as necessary, and only a sensor necessary for the corresponding installation region 20 may be installed inside the main body 100.

The air blowing part 300 is a component for forcibly moving the air 10 introduced into the treatment chamber 101 to the outside of the main body 100 through the filter part 400 which will be described below. The air blowing part 300 is installed in the treatment chamber 101 and has a structure that can forcibly suction the air 10 of the installation regions 20 into the air inlet 110 and then discharge the air 10 to the air outlet 120.

To this end, the air blowing part 300 may include a frame 310 installed to be fixed inside the treatment chamber 101 and having a passage 311 passing therethrough in the front-rear direction, an air blowing motor 320 fixed inside the passage 311, electrically connected to the controller 600, and having a driving shaft protruding to the front or rear, and an air blowing fan 330 having one axial side coupled to the driving shaft and a plurality of blades arranged in a radial direction.

The air blowing part 300 may be installed behind the filter part 400 which will be described below, and when the air blowing part 300 operates, the air 10 may be introduced through the air inlet 110 formed in a side surface of the main body 100 and then be forcibly discharged through the air outlet 120 formed in the front surface of the main body 100. In a process in which the air 10 passes through the treatment chamber 101, the air 10 may be filtered by the filter part 400.

The filter part 400 is a component for filtering the air 10 passing through the treatment chamber 101. The filter part 400 is provided in the treatment chamber 101 and passes and filters the air 10 introduced into the air inlet 110 and then move the air 10 to the air outlet 120.

Here, the filter part 400 may be vertically installed in the treatment chamber 101, and the filter part 400 may include one or more high-efficiency particulate air (HEPA) filters 410 provided in the treatment chamber 101 and capable of filtering out matter of 0.3 microns or less in size from the air 10 and one or more activated carbon filters 420 provided in front of or behind the HEPA filters 410 and including an activated carbon component.

The HEPA filters 410 may use filters that can collect at least 99.995% of particles of 0.3 microns or less in size from air. The HEPA filters 410 may effectively remove allergenic matter, dust, and other fine particles.

The activated carbon filters 420 may effectively adsorb VOCs, odors, and gaseous pollutants, and the activated carbon filters 420 can easily collect VOCs due to having a surface area of up to 400 m/g.

In addition, the treatment chamber 101 may be divided into a front space and a rear space by the filter part 400 having an area in an up-down direction and a left-right direction, and the air blowing part 300 may be installed in the rear space.

In this case, the air inlet 110 may horizontally communicate with the rear space, and the air outlet 120 formed in the front surface of the main body 100 may communicate with the front space formed in front of the filter part 400.

For example, when the air blowing fan 330 rotates, the air 10 introduced into the rear space through the air inlet 110 may be filtered while being passed forward through the rear of the filter part 400, and the air 10 that has passed through the filter part 400 may be discharged to the front of the main body 100 through the front space and the air outlet 120.

The sterilizing part 500 is a component for sterilizing the air 10 passing through the treatment chamber 101 and a surface of the filter part 400. One or more sterilizing parts 500 are provided in the treatment chamber 101 and, when turned on, radiate ultraviolet (UV) light to the outside and sterilize the air 10 of harmful components.

To this end, the sterilizing part 500 may include a circuit board provided on an inner sidewall of the treatment chamber 101 and having a length in the up-down direction and a plurality of UV lamps mounted on a surface of the circuit board and radiating UV light to the outside when turned on.

At this time, the sterilizing part 500 may be installed in the rear space of the treatment chamber 101 and may sterilize the air 10 introduced through the air inlet 110. In addition, the sterilizing part 500 may radiate UV light to the outside and sterilize a rear surface of the filter part 400.

The UV lamps may use UV light emitting diodes (UV LEDs) to radiate the UV light. In this case, the number of UV lamps may be changed to various numbers as necessary, and the position of the circuit board and the number of circuit boards may also vary.

In addition, although not illustrated, the sterilizing part 500 may be installed in the front space of the treatment chamber 101 and may sterilize the air 10 moving to the air outlet 120, or the sterilizing part 500 may be installed in both the rear space of the front space.

The controller 600 may be electrically connected to the measuring part 200, the air blowing part 300, and the sterilizing part 500, may control an operation of the air blowing part 300 according to the measured information transmitted from the measuring part 200, and may variably control a rotational speed of the air blowing fan 330, etc., according to the measured information transmitted from the measuring part 200.

Here, the controller 600 may be installed inside the treatment chamber 101, the controller 600 may be electrically connected to a power supply part 30 outside and receive driving power, and the controller 600 may be connected to the terminal part 720 using a wireless communication method by a communication module 710 which will be described below.

For example, when the particulate matter concentration measured by the measuring part 200 exceeds a predetermined reference value, the air blowing part 300 may be operated, and the speed of the air blowing fan 330 may be controlled according to a value of the measured particulate matter concentration.

In addition, the air purifying apparatus may further include a display window 610 coupled to an upper surface of the main body 100, electrically connected to the controller 600, and displaying various information through the upper surface. A liquid crystal display (LCD) or the like may be used as the display window 610, but various other types of displays may be selectively used as the display window 610 as necessary.

Meanwhile, the air purifying apparatus may further include the communication module 710 electrically connected to the controller 600 and the terminal part 720 transmitting and receiving information to and from the communication module 710 using a wireless communication method and provided to be remotely controllable.

The communication module 710 may be installed inside the treatment chamber 101 and may use a communication method such as Bluetooth or Wi-Fi, and various information (positions of installation regions, a particulate matter concentration, a CO2 concentration, etc.) may be displayed through a display window of the terminal part 720.

The terminal part 720 may be carried by a user or may be installed to be fixed on the wall 21 or the like of the installation regions 20, and the user may selectively control one or more of the air blowing part 300 and the sterilizing part 500 using an operation panel, an operation switch, and the like provided on the terminal part 720.

Meanwhile, as illustrated in FIGS. 9 to 11, the air purifying apparatus according to one embodiment of the present invention may further include an installation panel 810 coupled while in close contact with the wall 21 of the installation regions 20, a plurality of mounting members 820 each having a rear surface coupled to a front surface of the installation panel 810 and having a front end to which the rear surface of the main body 100 is coupled, a power terminal 830 connected to the power supply part 30 by a power cable 840 and exposed to the front of the installation panel 810, and a connector (not illustrated) provided on the main body 100 to allow insertion of the power terminal 830 and electrically connected to the controller 600.

In addition, the air purifying apparatus according to one embodiment of the present invention may further include an insertion groove 130 concavely formed in the rear surface of the main body 100, a catching groove 131 concavely formed in an upper portion of the insertion groove 130, a first bent section 821 extending to be bent forward from an upper end of the mounting member 820 and horizontally inserted into the insertion groove 130, a second bent section 822 extending to be bent upward from a front end of the first bent section 821 and vertically inserted into the catching groove 131, and a pressing end 823 extending to be bent downward from an upper end of the second bent section 822, located in front of the first bent section 821, and having a front surface that faces and elastically supports an inner side surface of the catching groove 131.

For example, when the main body 100 is brought into close contact with the front of the mounting member 820, the second bent section 822 and the pressing end 823 are horizontally inserted into the insertion groove 130. Then, when the main body 100 is moved downward to a catching height, upper ends of the second bent section 822 and the pressing end 823 are caught at and located on an upper end of the catching groove 131.

In this process, the front surface of the pressing end 823 may move upward while facing and elastically supporting the inner side surface of the catching groove 131, and since the pressing end 823 elastically supports the inner side surface of the catching groove 131, the main body 100 does not easily move upward due to an external force.

In addition, meanwhile, as illustrated in FIGS. 12 and 13, the air purifying apparatus according to one embodiment of the present invention may further include a lower slot 910 protruding from a bottom surface of the treatment chamber 101 and having a first insertion groove 911 concavely formed in an upper surface to allow insertion of a lower end of the filter part 400, and an upper slot 920 having a second insertion groove 921 concavely formed in a lower surface to allow insertion of an upper end of the filter part 400 and corresponding to an upper portion of the lower slot 910.

The first insertion groove 911 and the second insertion groove 921 may each have a length in the left-right direction to allow insertion of the filter part 400, and as illustrated in FIG. 13, after the front body and the rear body of the main body 100 are separated from each other, the upper end and the lower end of the filter part 400 may be coupled to the first insertion groove 911 and the second insertion groove 921, respectively, and after a predetermined amount of time passes, the front body and the rear body may be separated, and then the filter part 400 may be replaced.

In addition, the air purifying apparatus according to one embodiment of the present invention may further include a pair of first guide surfaces 912 formed on upper ends of both sides of the lower slot 910 and forming an angle inclined downward toward the first insertion groove 911, and a pair of second guide surfaces 922 formed on lower ends of both sides of the upper slot 920 and forming an angle inclined upward toward the second insertion groove 921.

For example, when the upper end and the lower end of the filter part 400 are inserted into the first insertion groove 911 and the second insertion groove 921, respectively, since the first guide surfaces 912 and the second guide surfaces 922 guide the upper end and the lower end, respectively, of the filter part 400, the filter part 400 can be easily coupled.

As a result, the air purifying apparatus according to the present invention can reduce electrical energy usage due to being driven based on air quality data measured in real time, can improve air purification efficiency due to being able to intensively purify the air 10 of a selected region, and is convenient to maintain because one or more air purifying apparatuses individually installed in various installation regions are managed in an integrated manner.

In addition, the air purifying apparatus according to the present invention can be installed in various environments due to being able to be extended indefinitely to the plurality of installation regions 20, has a small volume, which makes it easy to secure an installation space, and can improve air purification performance due to being able to simultaneously filter and sterilize air.

An air purifying apparatus according to the present invention can reduce electrical energy usage due to being driven based on air quality data measured in real time, can improve air purification efficiency due to being able to intensively purify air of a selected region, and is convenient to maintain because one or more air purifying apparatuses individually installed in various installation regions are managed in an integrated manner.

In addition, the air purifying apparatus according to the present invention can be installed in various environments due to being able to be extended indefinitely to a plurality of installation regions, has a small volume, which makes it easy to secure an installation space, and can improve air purification performance due to being able to simultaneously filter and sterilize air.

Specific embodiments of the air purifying apparatus according to the present invention have been described above, but it should be apparent that various modifications are possible within a scope not departing from the scope of the present invention.

Therefore, the scope of the present invention should not be defined as being limited to the embodiments described herein and should be defined not only by the claims below but also by their equivalents.

That is, the embodiments described above should be understood as being illustrative, instead of limiting, in all aspects, the scope of the present invention is shown by the claims below rather than by the detailed description provided above, and all changes or modifications derived from the meaning and scope of the claims and their equivalent concepts should be construed as being included in the scope of the present invention.

What is claimed is:

1. An air purifying apparatus of which one or more are provided in a plurality of installation regions, the air purifying apparatus comprising:

a plurality of main bodies each having a treatment chamber formed therein and having an air inlet and an air outlet formed therein;

a measuring part provided in each of the plurality of main bodies to measure environment information of the installation regions;

an air blowing part installed in the treatment chamber to forcibly suction air of the installation regions into the air inlet and then discharge the air to the air outlet;

a filter part provided in the treatment chamber to pass and filter the air introduced into the air inlet and then move the air to the air outlet;

a sterilizing part provided in the treatment chamber to, when turned on, radiate ultraviolet (UV) light to an outside and sterilize the air of harmful components;

a controller electrically connected to the measuring part, the air blowing part, and the sterilizing part and performing variable control of an operation of the air blowing part according to measured information transmitted from the measuring part;

a communication module electrically connected to the controller; and a terminal part transmitting and receiving information to and from the communication module using a wireless communication method and provided to be remotely controllable, wherein the measuring part includes a particulate matter sensor having a sensing side exposed to an outer surface of the corresponding main body, measuring a particulate matter concentration of the corresponding installation region, and transmitting the particulate matter concentration that is measured to the controller, a volatile organic compound sensor having a sensing side exposed to the outer surface of the corresponding main body, measuring a volatile organic compound concentration of the corresponding installation region, and transmitting the volatile organic compound concentration that is measured to the controller, a carbon dioxide sensor having a sensing side exposed to the outer surface of the corresponding main body, measuring a carbon dioxide concentration of the corresponding installation region, and transmitting the carbon dioxide concentration that is measured to the controller, and a temperature/humidity sensor having a sensing side exposed to the outer surface of the corresponding main body, measuring a temperature and a humidity level of the corresponding installation region, and transmitting the temperature and humidity level that is measured to the controller, the filter part divides the treatment chamber into a front space and a rear space, the air inlet and the air outlet are formed in both side surfaces and a front surface, respectively, of the corresponding main body to communicate with the front space and the rear space, respectively, and the air blowing part is provided in the rear space to move the air introduced into the air inlet to the front space through the filter part, wherein the filter part includes:

a high-efficiency particulate air (HEPA) filter provided in the treatment chamber and capable of filtering out matter of 0.3 microns or less in size from the air; and an activated carbon filter provided in front of or behind the HEPA filter and including an activated carbon component, wherein the air purifying apparatus further comprises:

an installation panel coupled in close contact with a wall of the corresponding installation region;

a plurality of mounting members each having a rear surface coupled to a front surface of the installation panel and having a front end to which a rear surface of the corresponding main body is coupled;

a power terminal connected to a power supply part by a power cable and exposed to a front of the installation panel; and a connector provided on the corresponding main body to allow insertion of the power terminal and electrically connected to the controller, wherein the corresponding main body further comprises:

an insertion groove concavely formed in the rear surface of the corresponding main body;

a catching groove concavely formed in an upper portion of the insertion groove;

a first bent section extending to be bent forward from an upper end of the corresponding mounting member and horizontally inserted into the insertion groove;

a second bent section extending to be bent upward from a front end of the first bent section and vertically inserted into the catching groove; and a pressing end extending to be bent downward from an upper end of the second bent section, located in front of the first bent section, and having a front surface that faces and elastically supports an inner side surface of the catching groove, wherein the air purifying apparatus further comprises:

a lower slot protruding from a bottom surface of the treatment chamber and having a first insertion groove concavely formed in an upper surface thereof to allow insertion of a lower end of the filter part; and an upper slot having a second insertion groove concavely formed in a lower surface thereof to allow insertion of an upper end of the filter part and corresponding to an upper portion of the lower slot, the first insertion groove and the second insertion groove each have a length in a left-right direction to allow insertion of the filter part, the lower slot further comprises a pair of first guide surfaces formed on upper ends of both sides of the lower slot and forming an angle inclined downward toward the first insertion groove, and the upper slot further comprises a pair of second guide surfaces formed on lower ends of both sides of the upper slot and forming an angle inclined upward toward the second insertion groove.

* * * * *